United States Patent [19]

McMahon et al.

[11] 4,285,352

[45] Aug. 25, 1981

[54] CONTINUOUS DUTY CHEMICALLY SANITIZING BATCH RINSE SYSTEM

[75] Inventors: William H. McMahon, Ludlow Falls; Louis F. Fraula, Troy; Stuart E. Athey, Troy; Thomas M. Johnson, Troy; Terrence W. Moore, Troy, all of Ohio

[73] Assignee: Hobart Corporation, Troy, Ohio

[21] Appl. No.: 74,649

[22] Filed: Sep. 12, 1979

[51] Int. Cl.[3] ..... B08B 3/02

[52] U.S. Cl. ..... 134/48; 134/57 D; 134/100; 239/68

[58] Field of Search ..... 134/48–50, 134/52, 56 R, 56 D, 57 R, 57 D, 100; 239/61, 68

[56] References Cited

U.S. PATENT DOCUMENTS

| | | | |
|---|---|---|---|
| 2,129,944 | 9/1938 | Ladewig | 134/94 X |
| 2,561,631 | 7/1951 | Negri | 134/57 R |
| 2,575,493 | 11/1951 | Hilliker | 134/58 D X |
| 2,592,884 | 4/1952 | Fox et al. | 134/58 D |
| 2,592,885 | 4/1952 | Fox et al. | 134/56 D X |
| 2,621,673 | 12/1952 | Hodgens, Jr. | 134/113 X |
| 2,687,139 | 8/1954 | Noble et al. | 134/57 R X |
| 2,704,082 | 3/1955 | Jackson | 134/95 |
| 2,771,893 | 11/1956 | Houghton | 134/57 D |
| 2,842,144 | 7/1958 | Lyman | 134/57 D |
| 2,859,760 | 11/1958 | Borell | 134/57 D X |
| 2,910,075 | 10/1959 | Federighi et al. | 134/49 X |
| 2,963,029 | 12/1960 | Bock | 134/58 D |
| 3,007,478 | 11/1961 | Leonhardt et al. | 134/57 R |
| 3,034,519 | 5/1962 | Jacobs | 134/95 |
| 3,139,890 | 7/1964 | Moran | 134/48 X |
| 3,474,965 | 10/1969 | Coleman | 239/68 |
| 3,478,757 | 11/1969 | Tuthill | 134/57 D |
| 3,903,909 | 9/1975 | Noren et al. | 134/58 D |
| 4,142,539 | 3/1979 | Shih et al. | 134/113 |
| 4,147,558 | 4/1979 | Fraula et al. | 134/10 |
| 4,147,559 | 4/1979 | Fraula et al. | 134/57 D |
| 4,209,343 | 6/1980 | Lane et al. | 134/102 X |
| 4,211,517 | 7/1980 | Schmid | 134/57 R X |

FOREIGN PATENT DOCUMENTS

| | | | |
|---|---|---|---|
| 223053 | 6/1959 | Australia . | |
| 426994 | 8/1972 | Australia . | |
| 1098492 | 2/1961 | Fed. Rep. of Germany . | |
| 1072346 | 3/1954 | France . | |
| 2395004 | 1/1979 | France | 134/57 D |
| 1272981 | 5/1972 | United Kingdom . | |

*Primary Examiner*—Robert L. Bleutge
*Attorney, Agent, or Firm*—Biebel, French & Nauman

[57] ABSTRACT

A chemically sanitizing rinse solution is prepared in batches of variable sizes, but with a preselected substantially constant proportion of water and chemical sanitizing agent, in a rinse solution mixing tank, for demand consumption on a continuous duty basis, by delivering the sanitizing agent to, and by admitting fresh water into, the mixing tank in response to predetermined level changes of the solution therein.

11 Claims, 12 Drawing Figures

CONTINUOUS DUTY CHEMICALLY SANITIZING BATCH RINSE SYSTEM

BACKGROUND OF THE INVENTION

This invention relates to warewashing machines, and more particularly to a chemically sanitizing rinse system which is particularly adapted for use in continuous duty warewashing machines such as conveyorized warewashers.

The inventions set forth in U.S. Pat. Nos. 4,142,539, 4,147,558, 4,147,559 and 4,209,343, all assigned to the assignee of the present invention represent major advances in energy saving chemically sanitizing warewasher technology. By air pumping and transporting the sanitizer (such as liquid sodium hypochlorite), by preparing the rinse solution in discrete batches, and by using the additional features taught therein, as appropriate, such as separately introducing the fresh rinse water and the concentrated sanitizer into a tank where dilution then takes place, the use of a rinse solution mixing tank which is separate from the wash and/or rinse chamber, the use of an independent rinse solution pump, and so forth, significant and important improvements in serviceability, reliability, and durability have been realized. Long felt needs extending over several decades have finally been met.

A review of the above-noted patents, however, will show that they are all directed to what may be termed "stationary rack" warewashing machines. By "stationary rack" is meant a machine in which the rack of dishes or other foodware is inserted and then left in a single or stationary position while the machine subjects it to consecutive washing and rinsing operations at that location. Some machines can hold several racks at once, but the distinguishing feature is that the racks remain stationary and the several washing and rinsing operations are all performed without movement of the rack. At the end of the machine cycle the rack is removed.

With respect to the above-noted applications, it will be appreciated that since the machine cycles are sequential, there is time during some portion of each machine cycle to prepare a batch of chemically sanitizing rinse solution. Also, the amount of solution needed per cycle, and the specific time at which the solution will be needed, are always predictable.

In larger commercial machines, however, this is unfortunately not always the case. Conveyor-type warewashing machines advance the dishes, either individually or in racks, and either continuously or intermitently, through several specialized work stations within the machine. At one location the dishes are washed, and at a later location rinsed. To these may be added a preliminary prewash, a subsequent drying stage, and so on. A machine "cycle" is therefore rather difficult to define. Dishes simply enter the machine at one end, at spacings which vary according to load demand, and exit from the opposite end some time later. During this passage, some or all of the work stations may either be operating continuously or be actuated in response to movement of the dishes or other foodware items therethrough. During periods of intense utilization, the operation of the various stations which are actuated in response to the movement of dishes through the warewasher can be virtually continuous for long periods of time.

In comparison with the stationary rack systems shown in the above-noted patents, it can be seen that a conveyorized warewashing machine requires a rinse system which can provide the chemically sanitizing rinse solution as needed. Since one cannot rely upon a predictable dwell period for preparing the rinse solution, the above-noted batch rinsing processes would appear to be inappropriate for conveyorized warewashers. This would be an unfortunate limitation since the significant advantages of the above-noted inventions, and the considerable energy saving potential thereof, would be especially valuable in these larger size and larger capacity conveyor-type warewashing machines.

A need thus remains for a system and method which provide a chemically sanitizing batch rinse system for warewashing machines which operate on a continuous duty or demand basis in which there may be no defined cycle portion for preparing a batch of chemically sanitizing rinse solution.

SUMMARY OF THE INVENTION

Briefly, the present invention meets the above needs and purposes with a system and method which prepare a sanitizing rinse solution of a predetermined or preselected concentration of chemical sanitizing agent on a batch basis, but vary and adjust the sizes of the individual batches according to the instantaneous demand requirements of the warewashing machine. The batches can even be prepared so as to maintain the proper substantially constant ratio or proportion of the sanitizing agent to water in the rinse solution while the solution is simultaneously being drawn for rinsing the foodware items, thus rendering the present invention suitable for use in conveyorized warewashing machines. (A "substantially constant" ratio or proportion of sanitizing agent to water, as used herein, is defined as a proportional mixture consistently falling in a desired range, such as approximately 60 to 75 ppm of NaOCl to water.) Further, these advantages are realized with the use of but a single rinse solution mixing tank, avoiding unnecessary duplication and expense of machine components.

A conveyorized warewashing machine will typically include a rinse station along the conveyor and a detector for activating the rinse station upon detecting foodware items therein. In the present invention, a rinse pump and spray system interconnected thereto are dedicated for pumping of rinse solution from the rinse solution mixing tank, under the control of the detector, and spraying the solution onto the foodware items as the conveyor moves them through the rinse station.

As the rinse solution is pumped from the rinse solution mixing tank, the level of solution in the tank drops. When it falls below a first lower predetermined level, a level detector within the mixing tank activates a sanitizer delivery means which delivers chemical sanitizing agent from a source thereof to the mixing tank. As the sanitizing agent is being delivered to the mixing tank, fresh water is also admitted to the tank by a suitable fresh water valve. Delivery of the chemical sanitizing agent and water is continued until the level of rinse solution in the mixing tank reaches a second, higher predetermined level at which another level detector deactivates the sanitizer delivery means and the fresh water valve, discontinuing the delivery of sanitizer and water to the tank.

In this manner, the size of the batch of chemically sanitizing rinse solution which is prepared at any particular time is responsive to the operation of the rinse pump. If the rinse pump operates for only a short period of time, for instance to rinse just one rack of foodware items, only a portion of the batch of solution in the mixing tank may be withdrawn. Therefore, a new batch will not be prepared until further operation of the rinse pump reduces the level of the solution in the tank to the lower predetermined level. On the other hand, if the rinse pump operates for an extended period, for instance to rinse several racks of foodware items in close succession, a much larger batch (or several larger batches since the rate at which the fluid enters the mixing tank exceeds the rate at which it is pumped out by the rinse pump) will be prepared as needed.

The sanitizer delivery means of the continuous duty batch rinse system of the present invention may take several forms, two of which are described herein. The first is in the form of a pump, such as of the peristaltic type, for directly moving liquid sanitizing agent (preferably a 5.2% solution of sodium hypochlorite) from a supply source into the rinse solution mixing tank. The fresh water supply line preferably includes a pressure regulating valve in series with a solenoid actuated water valve. The pressure regulating valve provides a known rate of delivery of water which is properly matched with a known rate of delivery of the sanitizer. This ensures introduction of water and sanitizer into the rinse solution mixing tank in the proper constant ratio or proportion to produce properly diluted chemically sanitizing batches of the rinse solution therein.

In the preferred embodiment, each of the rinse solution level detectors is comprised of a separate float and a switch physically connected to and actuated (such as magnetically) by each float within the rinse solution mixing tank, and electrically connected to a latching element, such as a holding relay, in the control circuit of the machine. The lower float switch is positioned adjacent the lower float at the location of the lower or first predetermined level in the mixing tank, and the upper switch adjacent the upper float at the location of the second or higher predetermined level. The lower and upper float switches are connected in series with the holding relay coil while the contacts of the relay are serially connected to each of three parallel branches being composed of, first, the upper float switch and relay coil in series, second, the sanitizer pump, and third, the water valve.

When the rinse tank is full of solution up to the location of the upper float, both upper and lower float switches are held open by their respective floats. With the switches in the open positions, the relay coil and sanitizer pump are de-energized and the water valve is closed. Then, arrival of a rack at the rinse station closes a detector switch which, in turn, activates the rinse pump to begin withdrawing solution from the mixing tank. As the level of the rinse solution drops below the upper float the float lowers and closes its switch. However, neither the relay coil, sanitizer pump, nor water valve are affected since the lower float switch is still open. But, if withdrawal of rinse solution from the tank continues, soon the solution level in the tank descends to the lower float, causing it to lower and close the lower switch. Now, both the upper and lower switches are closed, causing the relay coil and sanitizer pump to become energized and the water valve to be opened. Delivery of water and sanitizer in a predetermined ratio commences shortly thereafter into the rinse tank. The addition of solution to the tank causes the level thereof almost immediately to rise above the lower float, elevating the float and causing its switch to open. However, this will not affect the state of the relay coil, sanitizer pump, and water valve, since the relay contacts remain closed (until the upper float switch is opened). Ultimately (since withdrawal of solution takes place at a rate slightly slower than the rate at which it is being introduced) the rinse solution level in the tank will again reach the upper float, elevating the same and causing the upper float switch to open and terminate refilling of the tank.

In another form of the sanitizer delivery system, control of the water supply is made responsive to confirmed delivery of the sanitizing agent to the rinse solution mixing tank after the lapse of a predetermined time delay. Utilizing a sanitizer detector and transport system similar to the one disclosed in the above-noted U.S. Pat. No. 4,142,539 the presence of the electrically conductive sodium hypochlorite sanitizing liquid is detected by probes located substantially adjacent to an air aspirator positioned next to the point at which sanitizing liquid is released into the mixing tank. Since the solution is drawn upwardly from a supply bottle at the bottom of the machine by the aspirator, to which motive air is supply by an air compressor, the arrival of the conductive liquid sanitizing agent at the probes substantially confirms that it is being delivered to the mixing tank. Completion of the electrical circuit at the probes at the end of the supply tube near the release point then opens the solenoid water valve in the fresh water line to supply water to the rinse solution mixing tank.

When the upper float in the mixing tank is elevated by the rinsing solution level, its switch is opened, thereby closing the water valve and stopping the flow of sanitizing agent by shutting off the air compressor. Upon termination of delivery of the sanitizing agent, the agent falls back into the supply bottle, opening the electrical circuit at the probes. Alternatively, the open circuit at the probes could be used to deactivate the fresh water solenoid valve, closing the valve and stopping the water supply. Thus, water could be supplied to the mixing tank in response to delivery of the sanitizing agent thereto, but only as long as the sanitizing agent continues to be delivered. This would provide a fault check in the event that there is a problem with the sanitizer delivery means, such as an exhausted supply bottle of sanitizer solution.

It is therefore an object of the present invention to provide a continuous duty chemically sanitizing batch rinse system and apparatus; a dedicated system and apparatus in which the rinse solution is prepared on a batch basis, in which the size of each batch will be variable in response to the demand and operation of the warewashing machine; which is thus particularly suited for use in conveyorized warewashing machines; in which a chemical sanitizing agent and fresh water are admitted to a rinse solution mixing tank when the level therein falls below a first level, and continue to be admitted until the level reaches a second level; in which admission of the water and chemical sanitizing agent to the rinse solution mixing tank is in a predetermined ratio to provide a substantially constantly proportioned mixture of rinse solution; in which admission of water may be in response to confirmed delivery of chemical sanitizing agent to the mixing tank after a predetermined time delay; and to accomplish the above objects and purposes in an uncomplicated, durable, reliable and compact configuration readily suited for use in a wide variety of warewashing machines.

Other objects and advantages of the invention will be apparent from the following description, the accompanying drawings and the appended claims.

DESCRIPTION OF THE PREFERRED EMBODIMENT

Figure 1:
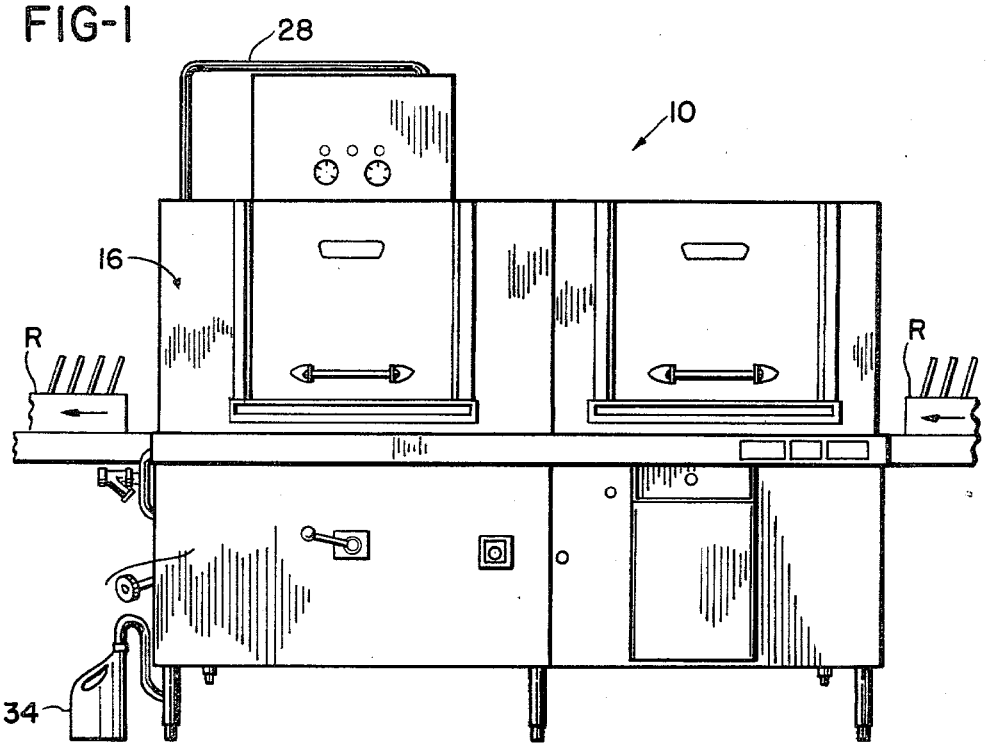
FIG. 1 is a front view of a conveyorized warewashing machine incorporating a continuous duty chemically sanitizing batch rinse system according to the present invention.
Figure 3A:
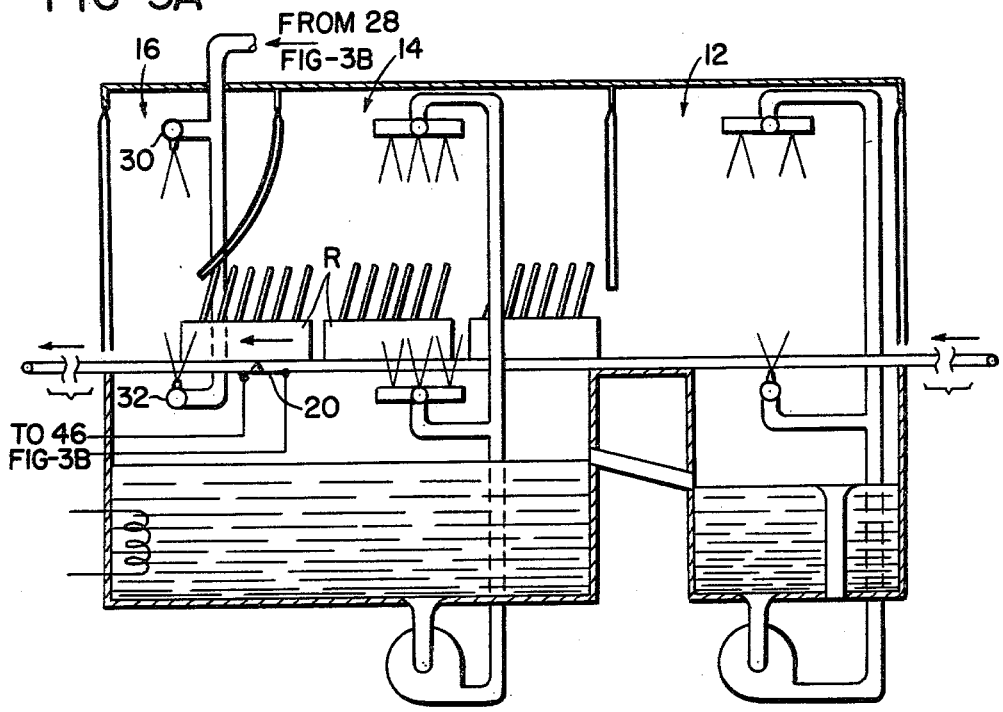
FIGS. 3A and 3B are diagrammatic illustrations of the principal components of the conveyorized warewashing machine and the batch rinse system.

FIG. 1 illustrates a conveyorized or conveyor-type warewashing machine 10 which incorporates a continuous duty chemically sanitizing batch rinse system according to the present invention. Referring to FIG. 3A, the warewashing machine 10 has a prewash station 12, a wash station 14, and a rinse station 16, and typically includes an endless chain conveyor or an indexing conveyor 18 for moving foodware items in racks R or otherwise, through the successive stations in the direction of the arrows in FIGS. 1 and 3A. Also, the machine 10 includes a rack or foodware detector 20 disposed adjacent the conveyor 18 and extending into the path of the racks R or ware at the entrance to the rinse station 16. Rinsing of a rack of foodware items at station 16 is initiated upon deflection of the detector 20 when contacted by the rack.

Figure 2:
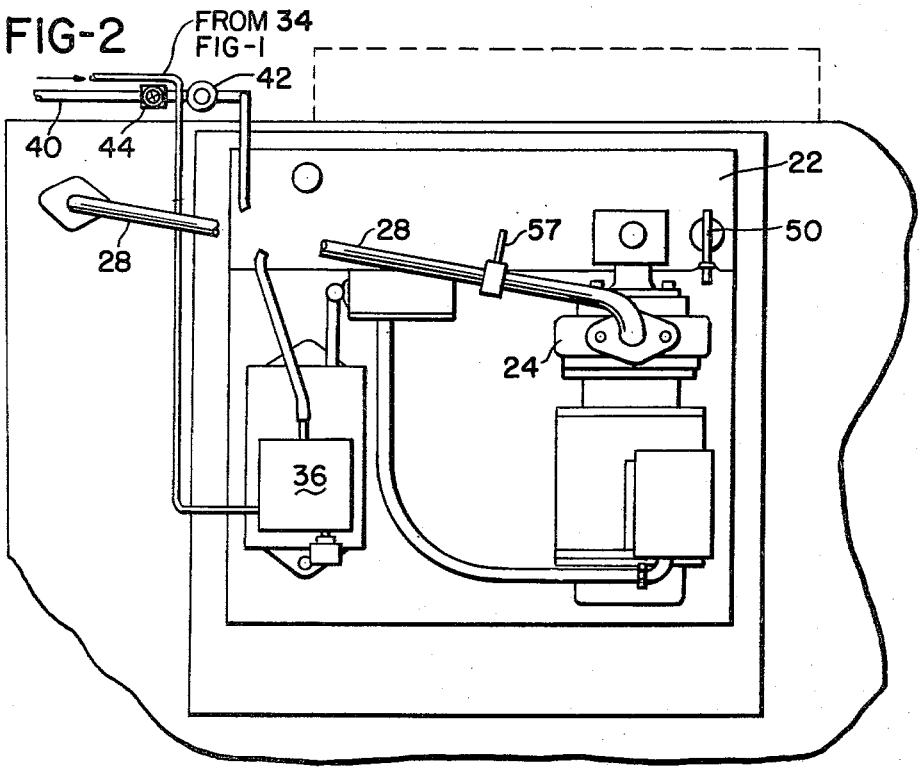
FIG. 2 is a top view of the batch rinse system.
Figure 3B:
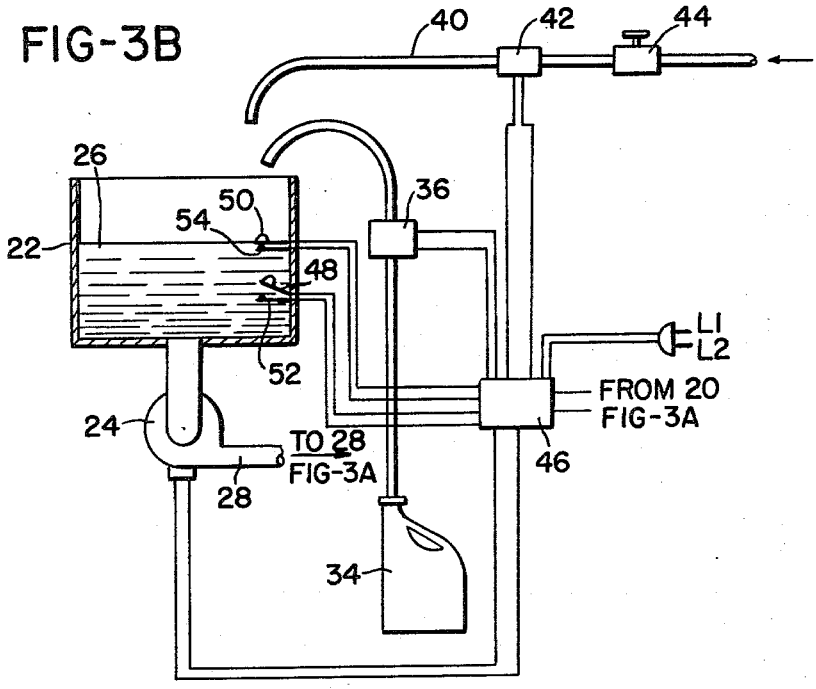

One form of the batch rinse system of the present invention, being illustrated in FIGS. 2 and 3B, includes a rinse solution mixing tank 22 and a rinse pump 24 for supplying rinse solution 26 from the tank 22 through pipe 28 to upper and lower dedicated rinse arms 30 and 32 stationarily mounted in the rinse station 16 above and below the path of movement of the racks R. Thus, the rinse solution 26 in tank 22 is pumped, on demand, by the rinse pump 24 through the rinse pipe 28, and to the rinse station 16 whenever a rack R of foodware items is detected in station 16 by the detector 20. Rinse station 16, as well as stations 12 and 14, may be any conventional and well-known designs of the kinds used in conveyorized warewashing machines for many years. Likewise, the detector 20 in the rinse station may be a conventional and well-known kind, such as a switch normally biased open, but which closes in response to being contacted by a rack of foodware items when moved by the conveyor 18 into the rinse station 16. Thus contact with the detector 20 by a rack energizes rinse pump 24 to supply rinse solution from tank 22 to the rinse arms 30 and 32 in station 16 for spraying the solution 26 onto the foodware items to rinse and chemically sanitize them.

This form of the batch rinse system further includes a source of chemical sanitizing agent such as a bottle 34 of 5.2% sodium hypochlorite solution, a sanitizer pump 36, such as of the peristaltic type, a source of fresh water (represented by pipe 40), means for admitting water in the form of a solenoid water valve 42, and a pressure regulating valve 44 (or some other suitable flow control device) in the fresh water line 40. Box 46 represents the electrical connections between various of these components, which will be described in detail with reference to FIGS. 4A–4F. The rinse solution mixing tank 22 has lower and upper solution level detectors in the form of a pair of floats 48 and 50 mounted therein, as depicted in FIG. 3B, which are raised and lowered by the solution level in the tank 22 and, in turn, open and close respective switches 52 and 54 disposed adjacent to, and connected with, the respective floats 48 and 50. Each float and switch combination may be devices similar to a liquid level switch, part no. 650-P, commercially available from Compac Engineering, Inc. of San Jose, Calif.

Operation of sanitizer pump 36 and opening of the water valve 42 are under the control of the first or lower float switch 52 and the second or upper float switch 54. When the level of the rinse solution 26 in tank 22 falls below the level of lower float 48 the float drops and closes its switch 52 which actuates pump 36 to deliver sanitizing agent to the mixing tank 22 and simultaneously opens water valve 42 to allow flow of fresh water into the tank 22. When the level of the rinse solution 26 rises in tank 22 to the upper float 50, this raises the same and opens the second or upper float switch 54, causing deactivation of the sanitizer pump 36, which discontinues the delivery of the sanitizing agent to tank 22, and closing of the water valve 42, which terminates the supply of fresh water to the tank.

Before continuing, at this point it should be mentioned that the direct detection of the solution level within the tank 22 by the lower and upper floats 48 and 50 in conjunction with the respective lower and upper float switches 52 and 54 is one of several possible ways of maintaining effective control over the solution level within the tank 22. Other direct or indirect means for controlling the solution level will come to mind and are considered to be within the scope of the present invention. This includes such means as a timer, used in place of the lower float and its associated switch, being present to initiate delivery of sanitizing agent and water after the lapse of a predetermined time so as to ensure that the solution level will not drop below a predetermined minimum level before refilling begins.

Figure 4A:
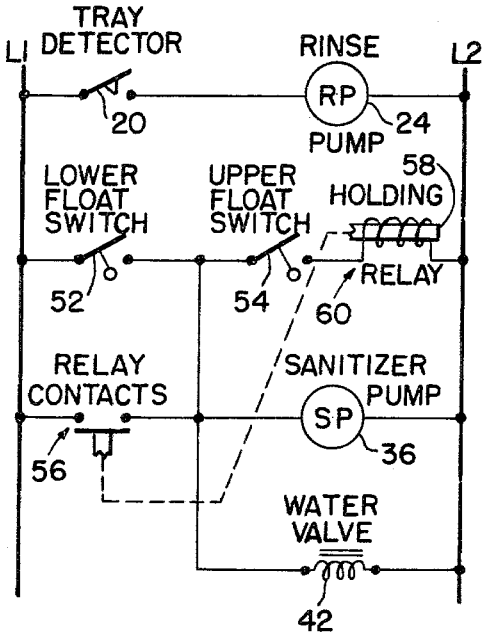
FIGS. 4A–4F are diagrammatic illustrations of the arrangement of an operational sequence performed by the principal components of the batch rinse system wherein one form of sanitizer delivery means is utilized.

FIGS. 4A–4F illustrate the comparative states of the rinse station rack detector switch 20, the lower and upper float switches 52 and 54, and a pair of relay contacts 56 of a holding relay 60 during a normal operational sequence of the batch rinse system of the present invention. FIG. 4A depicts the rack detector switch 20 in an open position, which implies that no rack has entered the rinse station 16 of the warewashing machine 10. Since the rinse pump 24 is connected in series with the open detector switch 20, the pump 24 is shut off. Furthermore, the assumption being made is that the rinse solution mixing tank 22 is full of rinse solution (water and sanitizer) up to the location of the upper float 50, consequently both the lower and upper float switches 52 and 54 are open, as seen in FIG. 4A. Since the holding relay coil is connected in series with the serially connected open float switches 52 and 54, the actuator 58 of the relay 60 is displaced away from the relay contacts 56 holding the latter in open condition, as also shown in FIG. 4A. With both the lower float switch 52 open and the relay contacts 56 open, the sanitizer pump (SP) 36 and the water valve 42, each being connected in series with each of the lower float switch 52 and the relay contacts 56, are thereby respectively deactivated and closed. Thus, the fresh water line is shut off and no chemical sanitizer is being dispensed from bottle 34.

Figure 4B:
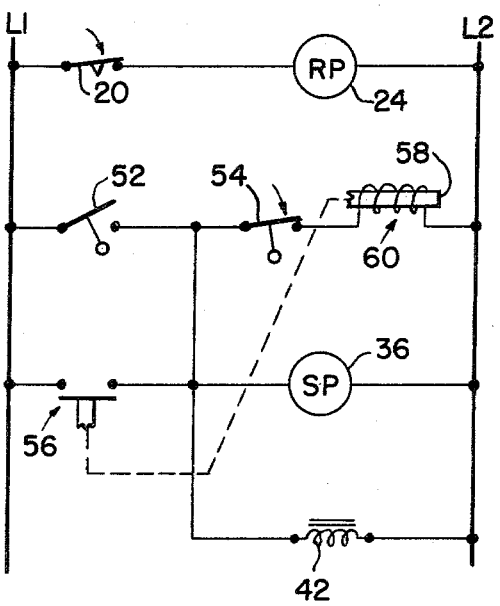

Referring now to FIG. 4B, assume that a first of several successive racks of foodware items has entered rinse station 16, and has contacted and closed the rack detector switch 20, which in turn, has activated the serially connected rinse pump 24. The pump 24 begins to withdraw rinse solution from the mixing tank 22 and causes the same to be sprayed on the foodware through arms 30 and 32 of the dedicated rinse system. As the level of rinse solution in the mixing tank drops below the upper float 50, its switch 54 closes as depicted in FIG. 4B. However, neither the holding relay actuator 58, the sanitizer pump 36, nor the water valve 42 is affected since the lower float switch 52 remains open.

Figure 4C:
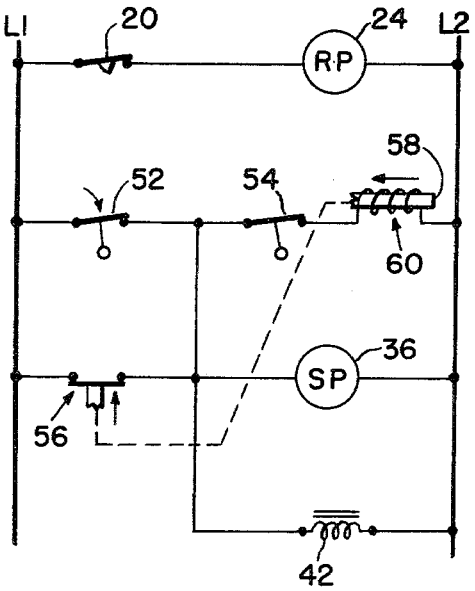

As withdrawal of rinse solution from mixing tank 22 and spraying of the foodware continues, soon the solution level in the tank 22 descends to the location of the lower float 48, causing its switch 52 to close, as depicted in FIG. 4C. Now, the circuit is completed through the sanitizer pump 36 and the water valve 42. Accordingly, the sanitizer pump 36 is turned on, which shortly thereafter causes injection of sanitizer into the tank. Also, concurrently the water valve 42 is opened which allows fresh water to be introduced into the tank 22. Because the flow of water into the tank occurs at a known rate due to presetting of the pressure regulating valve 44 at a desired predetermined pressure, for instance 20 psi, and because the flow of sanitizer into the tank takes place at a known rate due to pre-selection of a specific size pump, the water and sanitizer are calibrated to enter the tank 22 in the proper substantially constant proportion or ratio for producing properly diluted chemically sanitizing batches of rinse solution 26 in the tank 22, irrespective of the size of the batch pumped from the tank. Thus, delivery of sanitizer and water to the tank is responsive to pumping of solution from the tank 22 by the rinse pump 24, such that the size of each new batch of solution prepared is variable, depending upon the volume of solution pumped from the tank. However, the proportion of sanitizer and water in the batch remains substantially constant and is independent of the volume of solution pumped from the tank.

Figure 4D:
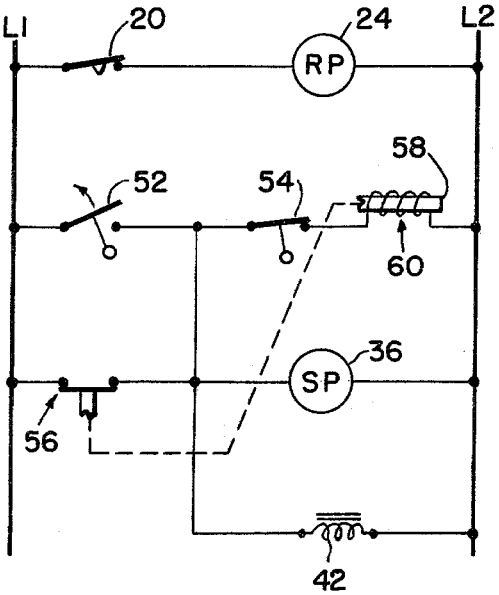

As the succession of racks illustrated in FIG. 3A feeds through the rinse station 16, withdrawal of rinse solution 26 from the mixing tank 22 by the rinse pump (RP) 24 continues. However, because of the closing of the lower float switch 52 as just described, more solution (water and sanitizer in the consistent predetermined proportion) is now being added to the mixing tank. Moreover, since the rinse pump 24 is preset or preselected to withdraw solution at a rate slightly slower than the rate at which it is being introduced, the level of the solution in the tank 22 almost immediately rises above the lower float 48, allowing its switch 52 to open. However, since the relay contacts 56 were closed by the holding relay actuator 58 (which moved leftward as seen in FIG. 4C) when the lower float switch 52 just previously closed, the opening of this float switch now, as seen in FIG. 4D, has no affect on the holding relay actuator 58, the sanitizer pump 36, and the water valve 42, since the relay contacts 56 and the upper float switch 54 both remain closed.

Figure 4E:
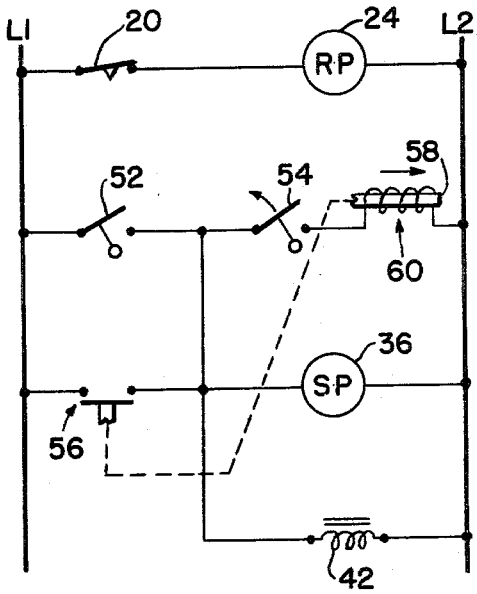
Figure 4F:
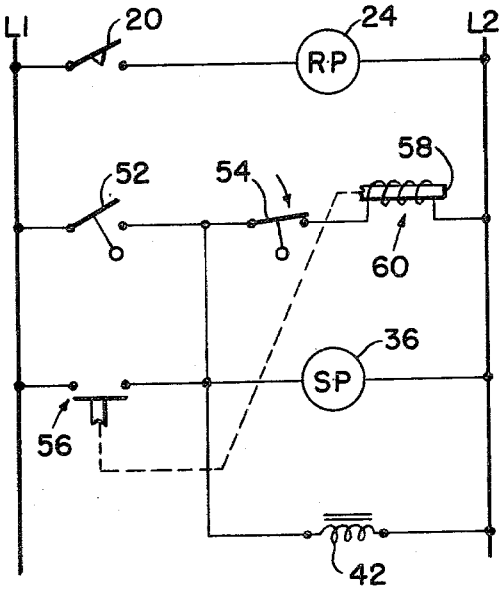

Ultimately the rinse solution level in the mixing tank 22 will again reach the higher location of the upper float 50, causing termination of the refilling of the tank 22. This may happen rather quickly if soon after the refill begins the last rack in the succession thereof exits from the machine 10, resulting in opening of the rinse detector switch 20, shutoff of the rinse pump 24, and thereby termination of withdrawal of any more rinse solution from the tank 22. (As shown in FIG. 2, an anti-siphoning device 57 is coupled to pipe 28 which vents the pipe when pump 24 is shut off to prevent continued siphoned flow of solution from the tank 22 to the rinse station 16.) But even assuming that the withdrawal of rinse solution continues concurrently as the level of the solution in the tank gradually rises and finally reaches the upper float 50, the refilling will then terminate and not start again until the solution level has again receded back down to the level of the lower float 48. The reason for this is that, as seen in FIG. 4E, the upper float switch 54 will open when the solution level reaches the upper float 50 and this will cause the circuit to the holding relay coil to be broken allowing its actuator 58 to return (because of spring bias) and open the relay contacts 56. With the lower float switch 52 already held open the lower float 48, and now with the relay contacts 56 open, the circuit is broken to the sanitizer pump 36 and the water valve 42, respectively shutting off and closing the latter components.

If withdrawal of solution from the tank 22 does continue, then immediately after the refill of the tank has terminated (when the sanitizer pump shuts off and the water valve closes) the solution level in the tank again starts dropping below the upper float. The upper float switch 54 then closes and conditions are now again as shown in FIG. 4B. So long as solution continues to be withdrawn, the operations just described with reference to FIGS. 4B–4E will be repeated. Operation of the rinse system will only return to and stop at the initial condition described with respect to FIG. 4A if the withdrawal of solution from the tank 22 is terminated while refilling of the tank is underway. Otherwise, if withdrawal of solution terminates after refilling has terminated and before the solution level in the tank has reached the lower float 48, the rinse system switches will remain in the condition shown in FIG. 4F with the solution level in the tank 22 between the lower and upper floats 48 and 50.

Figure 5:
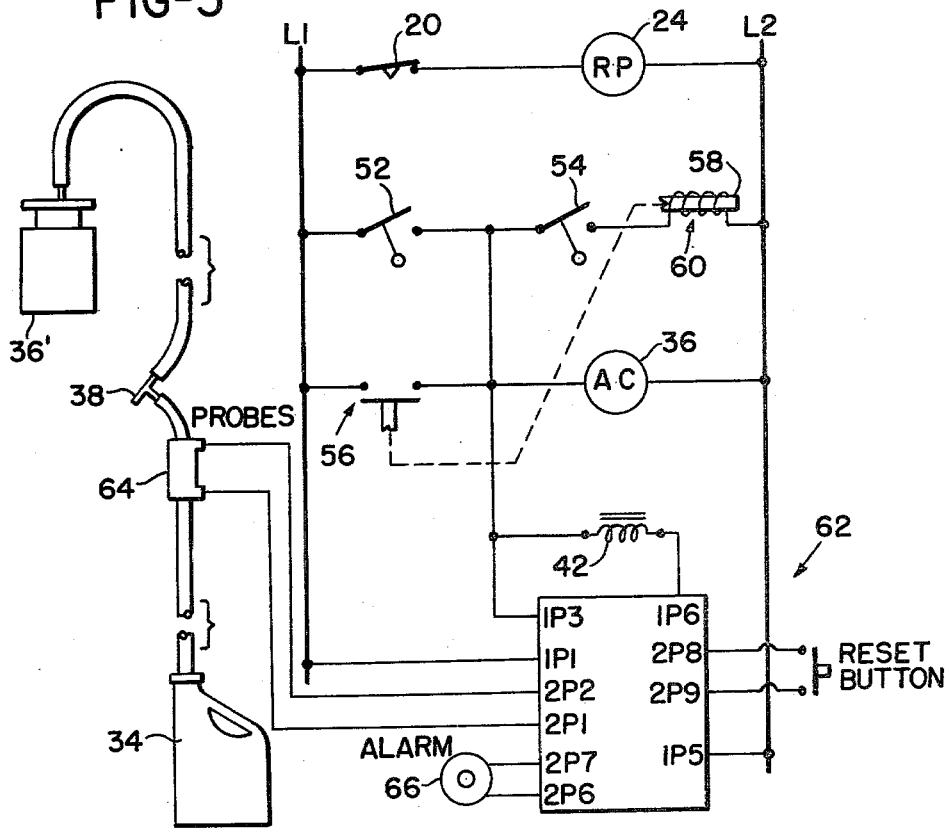
FIG. 5 is a diagrammatic illustration similar to that of FIG. 4A, but wherein another form of sanitizer delivery means is depicted, being comprised of a sanitizer transport system and a sanitizer detector with probe, and incorporated into the batch rinse system.
Figure 6:
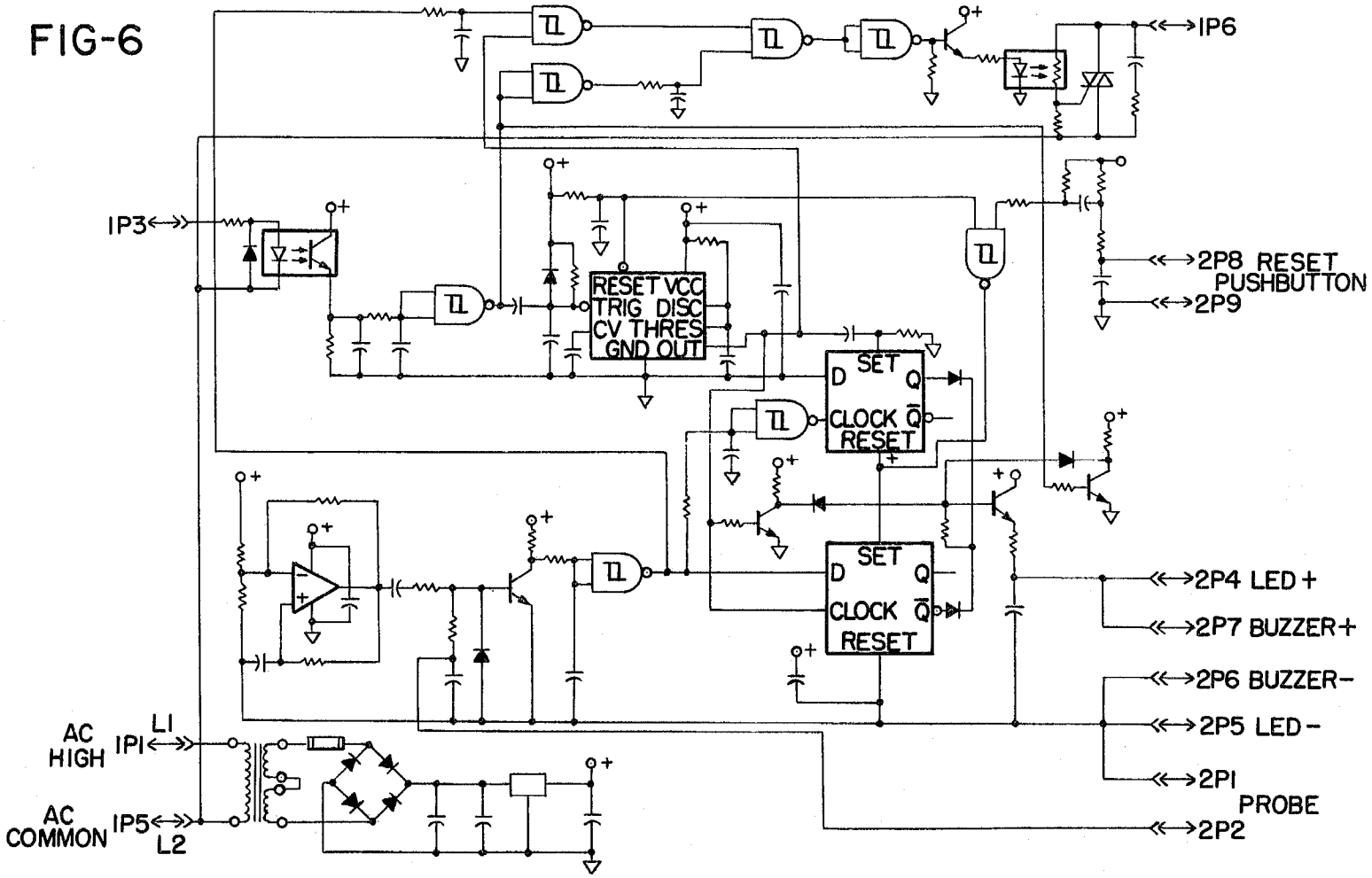
FIG. 6 is a detailed schematic of the sanitizer detector circuit of FIG. 5.

FIGS. 5 and 6 illustrate the rinse system wherein a sanitizer transport system, generally designated 62, and sanitizer detector probes 64 are incorporated providing the other form of the sanitizer delivery means. The probes 64 are inserted into the sanitizer feed line at a location adjacent to an aspirator 38, and thus proximate to where the sanitizer will be released into the mixing tank 22. In the circuit, an air compressor 36' which provides motive air to the aspirator 38 is substituted in place of sanitizer pump 36. The operation of the circuit 62 is basically similar to that described in above-noted U.S. Pat. No. 4,142,539 and therefore need not be described in detail. Suffice it to say that when the lower float switch 52 is closed, air compressor 36' is turned on. This causes the aspirator 38 to lift the sodium hypochlorite chemical sanitizing agent, which is electrically conductive, from bottle 34 to the release end of the aspirator, where it is discharged into tank 22. As the sanitizer reaches the aspirator, its presence between the probes 64 completes the circuit between them, causing system 62 to energize and open the water valve 42. Water then enters the tank 22 along with the chemical sanitizing agent until the solution level in the tank reaches the upper float, thereby raising it and opening the upper float switch 54.

If sanitizer does not appear at the probes 64 within a predetermined time delay after the lower float switch 52 is closed and the compressor 36 is turned on, then it will be assumed that the supply of sanitizer in the bottle 34 has been exhausted. Under such conditions an alarm 66 which may be connected in the circuit 62 will be sounded to alert the operator of the need to refill bottle 34. The circuit 62 may be "wired" to shut down the machine 10 at this point; however, the preferred approach is to allow the circuit 62 to open the water valve 42 after the expiration of the time delay, even though no sanitizer is delivered to the rinse system, in order to allow for an orderly termination of warewashing operations as the machine operator refills the bottle 34.

Eventually, the water and sanitizing agent will refill the tank 22 to the level of the upper float 50, either by overtaking the pump 24 or shortly after the pump is turned off. When the upper float 50 is reached by the solution level, the air compressor 36' is shut off and the water valve 42 closed, terminating the flow of chemical sanitizing agent and water into the tank 22. This allows the sanitizing agent to fall from the release point of the aspirator 38 and probe 64 back into the bottle 12.

In a typical conveyor-type warewashing machine, the racks will have a size of approximately 20×20 inches, and will be moved by the conveyor at a rate of approximately 6.5 feet per minute. Each rack will be sprayed with approximately 0.6 gallon of rinse solution in the rinse station. In the embodiment shown herein, the swing capacity of the rinse solution mixing tank 22 is only 1.2 gallons. With racks typically spaced as closely as an inch, it can be seen that this is a comparatively small capacity. However, since the size of each batch is responsive to the operation of the rinse pump 24, a larger rinse solution mixing tank 22 is unnecessary. If but a single rack moves through the rinse station 16, only a relatively small batch or portion of rinse solution in the tank 22 will be used. When several racks move through together, a larger batch of rinse solution will be prepared continuously in the tank 22, even while it is being pumped from the tank 22 by the rinse pump 24 and through the rinse arms 30 and 32 at the rinse station. Accordingly, it is unnecessary to use either a larger, more expensive and more bulky rinse solution mixing tank, or to have multiple mixing tanks which are cycled back and forth. Substantial economies are therefore realized.

As may be seen, therefore, the present invention has numerous advantages. As indicated, it makes it possible to utilize the significant improvements disclosed in the above-noted patents in a conveyorized warewashing machine. The present invention in one form of its sanitizer delivery means retains the advantages of air transport of the concentrated chemical sanitizing agent, in which deposits due to contact of the concentrated sanitizing agent with water are avoided. Likewise, the advantages of preparing the rinse solution on a batch basis and separately pumping it into the rinse station, independently of fresh water supply line fluctuation, are also realized here. In addition, the sequential control, in which the float switches operate the compressor and the sanitizer operates the water supply line, provide confirmation of delivery of the sanitizing agent. However, as described earlier, it is also possible to connect a sanitizer pump and the water valve in parallel, for simultaneous operation under the control of the float switches. Under normal circumstances, this would still result in delivery of the sanitizing agent and fresh water to the mixing tank in the proper ratio, and probes 64 and portions of detector system 62 could be retained in accordance with the teachings of the above-noted U.S. Pat. No. 4,142,539 to alert the machine operator when the sanitizing agent supply was exhausted.

While the apparatus herein described constitutes preferred embodiments of this invention, it is to be understood that the invention is not limited thereto, and that changes may be made therein without departing from the scope of the invention.

What is claimed is:

1. In a warewashing machine having a rinse station for supporting food ware items, a chemically sanitizing batch rinse system, comprising:
   (a) a rinse solution mixing tank;
   (b) a rinse pump and spray system connected for pumping rinse solution from said mixing tank, on demand, and spraying the solution onto foodware items at the rinse station;
   (c) a source of chemical sanitizing agent;
   (d) a source of fresh water; and
   (e) means operable to deliver sanitizing agent and fresh water into said mixing tank in predetermined proportions and at a rate greater than that at which the solution is pumped from the tank and in response to the solution level in said tank falling below a first lower level and operable to discontinue delivery of water and sanitizing agent when the solution level in said tank reaches a second higher upper level,
   (f) whereby a new batch of chemically sanitizing rinse solution is prepared each time the solution level in said mixing tank falls below said lower level and the size of each new batch prepared is dependent on the volume of solution pumped from said tank but is of substantially constant proportion of sanitizing agent and water.

2. The system of claim 1 wherein said operable delivery means comprises:
   (a) a first lower float located at said first lower level within said tank;
   (b) a second upper float located at said second higher upper level within said tank;
   (c) sanitizing agent delivery means connected to said source of agent and operable to deliver agent into said tank;
   (d) water admitting means connected to said source of water and operable to deliver water into said tank;
   (e) control means mechanically actuatable by said floats in response to changes in the solution level at said upper and lower levels within said tank and electrically interconnected to said sanitizing agent delivery means and said water admitting means for operating and terminating operation of the same in response to predetermined changes in solution level at said upper and lower levels.

3. The system of claim 1 wherein said operable delivery means comprises:
   (a) a first lower float located at said first lower level within said mixing tank;

(b) a first electrical switch actuatable by said lower float to render said first switch electrically conductive when the solution level in said tank falls below said first level and non-conductive when the solution level rises above said first level;

(c) a second upper float located at said second higher level within said mixing tank;

(d) a second electrical switch actuatable by said upper float to render said second switch electrically conductive when the solution level in said tank falls below said second level and non-conductive when the solution level rises above said second level;

(e) sanitizing agent delivery means connected to said source of agent and operable to deliver agent into said tank;

(f) water admitting means connected to said source of water and operable to deliver water into said tank; and (g) electrical control means interconnecting said switches and said respective sanitizing agent delivery and water admitting means such that when said first and second switches are conductive, when the solution level has fallen below said lower level, said sanitizing agent delivery means and water admitting means deliver agent and water to said tank, while when said first and second switches are non-conductive, when the solution level has risen above said upper level, said sanitizing agent delivery means and water admitting means terminate delivery of agent and water to said tank.

4. The system of claim 3 wherein said control means comprises:

(a) an electrical actuator connected in series with said first and second switches and movable to a first position when both said switches are rendered electrically conductive;

(b) an electrical contact element actuatable between electrically conductive and non-conductive positions by said actuator; and (c) circuitry interconnecting said second switch and electrical actuator in series in a first branch, said sanitizing agent delivery means in a second branch parallel to said first branch, and said water admitting means in a third branch parallel to each of said first and second branches, said contact element being connected in series to each of said first, second, and third parallel branches such that when said first and second switches are both rendered conductive, when said solution level falls below said lower level, said actuator moves to its first position and actuates said contact element to its conductive position, and thereafter when said first switch is rendered non-conductive, while said second switch remains conductive, when said solution level rises above said lower level but has still not reached said upper level, said contact element will remain in its conductive position, retaining said actuator in its first position and operating said sanitizing agent delivery means and said water admitting means, until said second switch is rendered non-conductive when said solution level rises above said upper level.

5. In a warewashing machine having a rinse station including a spray system for spraying a sanitizing rinse solution onto foodware items at the rinse station, a chemically sanitizing batch rinse system, comprising:

a rinse solution mixing tank, a rinse pump connected to pump rinse solution from said mixing tank to said spray system, a source of chemical sanitizing agent, sanitizer delivery means connecting said source of sanitizing agent to said mixing tank, fresh water admitting means connected to said tank and controlling flow of water into said tank, level detector means associated with said mixing tank and operative to sense predetermined upper and lower levels of solution in said tank, control means, including said level detector means, connected to said sanitizer delivery means and to said water admitting means to admit fresh water into said tank when said sanitizer delivery means is delivering sanitizing agent to said tank, and to stop admitting water when the delivery of the sanitizing agent is discontinued, to prepare a batch of chemically sanitizing rinse solution each time the level in said mixing tank falls below said lower predetermined level and then reaches said upper predetermined level, the size of each batch thereby being dependent on the volume of solution withdrawn from said tank by operation of said rinse pump.

6. The system of claim 5 wherein said sanitizer delivery means and water admitting means are calibrated to deliver the chemical sanitizing agent and fresh water to said rinse solution mixing tank in the proper substantially constant ratio for producing properly diluted chemically sanitizing batches of rinse solution therein.

7. The system of claim 5 wherein said water admitting means further comprises means for admitting the fresh water in response to delivery of said sanitizing agent to said mixing tank.

8. The system of claim 7 wherein said water admitting means further comprises means for confirming delivery of the sanitizing agent to said rinse solution mixing tank and for admitting the fresh water into said tank as long as the sanitizing agent is being delivered.

9. The system of claim 5 wherein said chemical sanitizing agent is a conductive liquid.

10. The system of claim 9 wherein:

(a) said sanitizer delivery means lifts said conductive liquid sanitizing agent to a release point at said rinse solution mixing tank when delivering sanitizing agent thereto, and allows the sanitizing agent to fall from said release point when delivery is discontinued, and (b) said water admitting means further comprises circuit means having a portion located in said sanitizer delivery means substantially adjacent said release point for being contacted by said conductive sanitizing agent and completing an electrical circuit to operate said water admitting means in response thereto.

11. For use in a conveyorized warewashing machine, a continuous duty chemically sanitizing batch rinse system comprising:

(a) means defining a rinse station along the warewashing machine conveyor, (b) rinse station detecting means for detecting the presence of foodware items in said rinse station, (c) a rinse solution mixing tank, (d) a rinse pump and spray system connected to and controlled by said rinse station detecting means for pumping and spraying rinse solution from said rinse solution mixing tank onto foodware items when detected in said rinse station, (e) level detecting means for detecting the level of solution in said mixing tank, (f) a source of conductive liquid chemical sanitizing agent, (g) sanitizer delivery means connected to said level detecting means and to said source of chemical sanitizing agent for lifting sanitizing agent to a release point at said rinse solution mixing tank and delivering the agent to said tank when said level detecting means detects a level therein below a first predetermined level, for discontinuing delivery of the agent and allowing it to fall from said release point back to said sanitizing agent source when the solution level in said mixing tank reaches a second predetermined level above said first predetermined level, (h) water admitting means connected to controllably admit fresh water into said mixing tank from a suitable fresh water supply and including circuit means having a portion located in said sanitizer delivery means substantially adjacent said release point for being contacted by said conductive sanitizing agent to confirm delivery of the sanitizing agent to said rinse solution mixing tank and complete an electrical circuit to operate said water admitting means in response thereto, said water admitting means thereby controllably admitting said fresh water into said mixing tank in response to and as long as the sanitizing agent is being delivered to said mixing tank, and stopping admission of the water when the delivery of the sanitizing agent is discontinued, and (i) said sanitizer delivery means and water admitting means being calibrated to deliver the chemical sanitizing agent and fresh water to said rinse solution mixing tank in the proper ratio to prepare a properly diluted batch of chemically sanitizing rinse solution each time the level in said mixing tank falls below said first predetermined level and then reaches said second predetermined level, the size of each batch thereby being dependent on the volume of solution withdrawn from the tank by operation of said rinse pump.

* * * * *